US010049610B2

(12) United States Patent
Ikeda et al.

(10) Patent No.: US 10,049,610 B2
(45) Date of Patent: Aug. 14, 2018

(54) DISPLAY APPARATUS AND METHOD FOR CONTROLLING SAME

(71) Applicant: CANON KABUSHIKI KAISHA, Tokyo (JP)

(72) Inventors: Takeshi Ikeda, Ebina (JP); Izumi Kanai, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 133 days.

(21) Appl. No.: 14/943,501

(22) Filed: Nov. 17, 2015

(65) Prior Publication Data

US 2016/0155372 A1 Jun. 2, 2016

(30) Foreign Application Priority Data

Nov. 27, 2014 (JP) ..... 2014-240503
Nov. 5, 2015 (JP) ..... 2015-217743

(51) Int. Cl.
*G09G 3/20* (2006.01)
*G09G 3/34* (2006.01)
*G09G 3/36* (2006.01)

(52) U.S. Cl.
CPC ..... *G09G 3/2092* (2013.01); *G09G 3/342* (2013.01); *G09G 3/3426* (2013.01); *G09G 3/3648* (2013.01); *G09G 2320/0233* (2013.01); *G09G 2320/062* (2013.01); *G09G 2320/066* (2013.01); *G09G 2320/0626* (2013.01); *G09G 2320/0646* (2013.01); *G09G 2320/0686* (2013.01);

(Continued)

(58) Field of Classification Search
CPC ..... G09G 3/342; G09G 3/3426; G09G 2320/0233; G09G 2320/062; G09G 2320/0626; G09G 2320/0646
See application file for complete search history.

(56) References Cited

U.S. PATENT DOCUMENTS

2010/0066752 A1* 3/2010 Watanuki ..... G09G 3/3426 345/589
2010/0238356 A1* 9/2010 Kida ..... G09G 3/20 348/618

(Continued)

FOREIGN PATENT DOCUMENTS

JP 2008051905 A 3/2008
JP 2013148870 A 8/2013
JP 2013182268 A 9/2013

OTHER PUBLICATIONS

Apr. 21, 2016 European Search Report issued in corresponding European Application No. 15195785.9.
U.S. Appl. No. 14/799,890, filed Jul. 15, 2015.

*Primary Examiner* — Antonio A Caschera
(74) *Attorney, Agent, or Firm* — Fitzpatrick, Cella, Harper & Scinto

(57) ABSTRACT

A display apparatus including: a display panel; a light emitting unit having a plurality of light sources; an acquiring unit acquiring feature values of an input image for divided regions respectively corresponding to the light sources; and a control unit configured to control, wherein in a case where the input image is a second image not including the predetermined object image, the control unit does not implement control operation of controlling the brightness of the light sources corresponding to the dark divided regions lower than the brightness of the light sources corresponding to the other divided regions.

21 Claims, 7 Drawing Sheets

(52) U.S. Cl.
CPC ..... *G09G 2340/14* (2013.01); *G09G 2360/16* (2013.01); *G09G 2380/08* (2013.01)

(56) References Cited

U.S. PATENT DOCUMENTS

| | | | | |
|---|---|---|---|---|
| 2010/0315445 | A1 | 12/2010 | An et al. | |
| 2012/0293565 | A1 | 11/2012 | Mito | |
| 2013/0155125 | A1 | 6/2013 | Inamura | |
| 2014/0043350 | A1 | 2/2014 | Ikeda | |
| 2014/0055505 | A1 | 2/2014 | Ikeda et al. | |
| 2014/0085360 | A1 | 3/2014 | Ohno et al. | |
| 2015/0055025 | A1 | 2/2015 | Gotoh | |
| 2016/0127650 | A1* | 5/2016 | Van Den Herik | H04N 5/23293 348/333.01 |

* cited by examiner

| | 1 | 2 | 3 | 4 | 5 | 6 | 7 | 8 | 9 | 10 |
|---|---|---|---|---|---|---|---|---|---|---|
| 1 | 1536 | 1536 | 1536 | 1536 | 1536 | 1536 | 1536 | 1536 | 1536 | 1536 |
| 2 | 0 | 0 | 0 | 0 | 0 | 0 | 0 | 0 | 0 | 0 |
| 3 | 0 | 0 | 0 | 0 | 0 | 0 | 0 | 0 | 0 | 0 |
| 4 | 0 | 0 | 0 | 0 | 0 | 0 | 0 | 0 | 0 | 0 |
| 5 | 0 | 0 | 0 | 0 | 0 | 0 | 0 | 0 | 0 | 0 |
| 6 | 0 | 0 | 0 | 0 | 0 | 0 | 0 | 0 | 0 | 0 |
| 7 | 0 | 0 | 0 | 0 | 0 | 0 | 0 | 0 | 0 | 0 |

| | 1 | 2 | 3 | 4 | 5 | 6 | 7 | 8 | 9 | 10 |
|---|---|---|---|---|---|---|---|---|---|---|
| 1 | 1536 | 1536 | 1536 | 1536 | 1536 | 1536 | 1536 | 1536 | 1536 | 1536 |
| 2 | 0 | 0 | 1280 | 1280 | 0 | 0 | 0 | 0 | 0 | 0 |
| 3 | 0 | 0 | 1600 | 2000 | 1800 | 0 | 0 | 0 | 0 | 0 |
| 4 | 0 | 0 | 1280 | 2560 | 1280 | 0 | 0 | 0 | 0 | 0 |
| 5 | 0 | 0 | 1208 | 2000 | 1800 | 0 | 0 | 0 | 0 | 0 |
| 6 | 0 | 0 | 1600 | 1700 | 0 | 0 | 0 | 0 | 0 | 0 |
| 7 | 0 | 0 | 1280 | 0 | 0 | 0 | 0 | 0 | 0 | 0 |

| | 1 | 2 | 3 | 4 | 5 | 6 | 7 | 8 | 9 | 10 |
|---|---|---|---|---|---|---|---|---|---|---|
| 1 | 1536 | 1536 | 1536 | 1536 | 1536 | 1536 | 1536 | 1536 | 1536 | 1536 |
| 2 | 0 | 0 | 600 | 200 | 0 | 0 | 0 | 0 | 0 | 0 |
| 3 | 0 | 0 | 800 | 1300 | 1200 | 0 | 0 | 0 | 0 | 0 |
| 4 | 0 | 0 | 700 | 2000 | 600 | 0 | 0 | 0 | 0 | 0 |
| 5 | 0 | 0 | 800 | 1300 | 1200 | 0 | 0 | 0 | 0 | 0 |
| 6 | 0 | 0 | 800 | 1200 | 0 | 0 | 0 | 0 | 0 | 0 |
| 7 | 0 | 0 | 100 | 0 | 0 | 0 | 0 | 0 | 0 | 0 |

| | 1 | 2 | 3 | 4 | 5 | 6 | 7 | 8 | 9 | 10 |
|---|---|---|---|---|---|---|---|---|---|---|
| 1 | 1200 | 1200 | 1200 | 1200 | 1200 | 1200 | 1200 | 1200 | 1200 | 1200 |
| 2 | 0 | 0 | 800 | 120 | 0 | 0 | 0 | 0 | 0 | 0 |
| 3 | 0 | 0 | 1100 | 1200 | 300 | 0 | 0 | 0 | 0 | 0 |
| 4 | 0 | 0 | 800 | 1200 | 600 | 0 | 0 | 0 | 0 | 0 |
| 5 | 0 | 0 | 1100 | 1200 | 300 | 0 | 0 | 0 | 0 | 0 |
| 6 | 0 | 0 | 1000 | 1000 | 0 | 0 | 0 | 0 | 0 | 0 |
| 7 | 0 | 0 | 60 | 0 | 0 | 0 | 0 | 0 | 0 | 0 |

| | 1 | 2 | 3 | 4 | 5 | 6 | 7 | 8 | 9 | 10 |
|---|---|---|---|---|---|---|---|---|---|---|
| 1 | 1 | 1 | 1 | 1 | 1 | 1 | 1 | 1 | 1 | 1 |
| 2 | 0 | 0 | 1 | 1 | 0 | 0 | 0 | 0 | 0 | 0 |
| 3 | 0 | 0 | 1 | 1 | 1 | 0 | 0 | 0 | 0 | 0 |
| 4 | 0 | 0 | 1 | 1 | 1 | 0 | 0 | 0 | 0 | 0 |
| 5 | 0 | 0 | 1 | 1 | 1 | 0 | 0 | 0 | 0 | 0 |
| 6 | 0 | 0 | 1 | 1 | 0 | 0 | 0 | 0 | 0 | 0 |
| 7 | 0 | 0 | 0 | 0 | 0 | 0 | 0 | 0 | 0 | 0 |

*Fig.4*

| | 1 | 2 | 3 | 4 | 5 | 6 | 7 | 8 | 9 | 10 |
|---|---|---|---|---|---|---|---|---|---|---|
| 1 | 4000 | 1500 | 1500 | 1500 | 1500 | 1500 | 1500 | 1500 | 1500 | 1500 |
| 2 | 4000 | 1500 | 1500 | 1500 | 1500 | 0 | 0 | 0 | 1500 | 1500 |
| 3 | 4000 | 1500 | 1500 | 1500 | 1500 | 0 | 0 | 0 | 1500 | 1500 |
| 4 | 4000 | 1500 | 1500 | 1500 | 1500 | 1500 | 1500 | 1500 | 1500 | 1500 |
| 5 | 1500 | 1500 | 1500 | 1500 | 1500 | 1500 | 1500 | 1500 | 1500 | 1500 |
| 6 | 1500 | 1500 | 1500 | 1500 | 1500 | 1500 | 1500 | 1500 | 1500 | 1500 |
| 7 | 3000 | 3000 | 2000 | 2000 | 2000 | 2000 | 2000 | 2000 | 2000 | 2000 |

| | 1 | 2 | 3 | 4 | 5 | 6 | 7 | 8 | 9 | 10 |
|---|---|---|---|---|---|---|---|---|---|---|
| 1 | 1200 | 1200 | 1200 | 1200 | 1200 | 1200 | 1200 | 1200 | 1200 | 1200 |
| 2 | 1200 | 1200 | 1200 | 1200 | 1200 | 0 | 0 | 0 | 1200 | 1200 |
| 3 | 1200 | 1200 | 1200 | 1200 | 1200 | 0 | 0 | 0 | 1200 | 1200 |
| 4 | 1200 | 1200 | 1200 | 1200 | 1200 | 1200 | 1200 | 1200 | 1200 | 1200 |
| 5 | 1200 | 1200 | 1200 | 1200 | 1200 | 1200 | 1200 | 1200 | 1200 | 1200 |
| 6 | 1200 | 1200 | 1200 | 1200 | 1200 | 1200 | 1200 | 1200 | 1200 | 1200 |
| 7 | 1200 | 1200 | 1200 | 1200 | 1200 | 1200 | 1200 | 1200 | 1200 | 1200 |

| | 1 | 2 | 3 | 4 | 5 | 6 | 7 | 8 | 9 | 10 |
|---|---|---|---|---|---|---|---|---|---|---|
| 1 | 2100 | 1500 | 1500 | 1500 | 1500 | 1500 | 1500 | 1500 | 1500 | 1500 |
| 2 | 2300 | 1500 | 1500 | 1500 | 1500 | 0 | 0 | 0 | 1500 | 1500 |
| 3 | 2330 | 1500 | 1500 | 1500 | 1500 | 0 | 0 | 0 | 1500 | 1500 |
| 4 | 2100 | 1500 | 1500 | 1500 | 1500 | 1500 | 1500 | 1500 | 1500 | 1500 |
| 5 | 1500 | 1500 | 1500 | 1500 | 1500 | 1500 | 1500 | 1500 | 1500 | 1500 |
| 6 | 1500 | 1500 | 1500 | 1500 | 1500 | 1500 | 1500 | 1500 | 1500 | 1500 |
| 7 | 2100 | 1800 | 1600 | 1600 | 1600 | 1600 | 1600 | 1600 | 1600 | 1600 |

| | 1 | 2 | 3 | 4 | 5 | 6 | 7 | 8 | 9 | 10 |
|---|---|---|---|---|---|---|---|---|---|---|
| 1 | 1 | 1 | 1 | 1 | 1 | 1 | 1 | 1 | 1 | 1 |
| 2 | 1 | 1 | 1 | 1 | 1 | 0 | 0 | 0 | 1 | 1 |
| 3 | 1 | 1 | 1 | 1 | 1 | 0 | 0 | 0 | 1 | 1 |
| 4 | 1 | 1 | 1 | 1 | 1 | 1 | 1 | 1 | 1 | 1 |
| 5 | 1 | 1 | 1 | 1 | 1 | 1 | 1 | 1 | 1 | 1 |
| 6 | 1 | 1 | 1 | 1 | 1 | 1 | 1 | 1 | 1 | 1 |
| 7 | 1 | 1 | 1 | 1 | 1 | 1 | 1 | 1 | 1 | 1 |

DISPLAY APPARATUS AND METHOD FOR CONTROLLING SAME

BACKGROUND OF THE INVENTION

Field of the Invention

The present invention relates to a display apparatus and a method for controlling the same.

Description of the Related Art

In some display apparatuses such as liquid crystal displays using a backlight, the backlight is constituted by a plurality of light sources whose brightness is capable of being separately controlled. Such display apparatuses may improve display contrast by controlling the brightness of respective light sources according to input images and correcting the input images according to the brightness of the respective light sources (see, for example, Japanese Patent Application Laid-open No. 2008-51905). This technology is called local dimming. However, image correction may cause degradation in original input images due to influence by, for example, quantization error or the like.

Liquid crystal displays have also been used for interpretation with X-ray or mammography. In such medical image observation, it is required to faithfully display original input images for accurate diagnosis. However, if display images are degraded due to image processing, the faithful display of the images is not allowed.

In view of this problem, there has been proposed technology in which local dimming is applied only to light sources corresponding to background regions not to be observed and is not applied to light sources corresponding to object regions to be observed in input images (see, for example, Japanese Patent Application Laid-open No. 2013-148870). Thus, since black floating caused by light leaking from a liquid crystal display is prevented in dark background regions, an observer such as an interpretation operator may be free from the feelings of interference. In addition, since degradation due to image processing is prevented in object regions and input images are faithfully displayed, diagnosis with precision is made possible.

SUMMARY OF THE INVENTION

There may be cases that images other than medical images are displayed and used on liquid crystal displays on which the medical images are observed. For example, when an image of an operating system (OS) output from a personal computer or the like is displayed, it may include a text display region in which bright-color texts are displayed in a dark-color background. In the technology of Japanese Patent Application Laid-open No. 2013-148870, there is a likelihood that the background of a text display region is falsely recognized as the background of medical images and local dimming is applied to the text display region. As a result, the brightness of light sources corresponding to the text display region reduces, and light leaks from light sources having high brightness around the text display region to cause halo in the text display region. In addition, for images other than medical images, there is a likelihood that image producers intend to give expression full of gradation even in dark regions. However, when the brightness of light sources corresponding to the dark regions reduces, gradation expected by the image producers is not successfully displayed in the dark regions. As described above, there is a likelihood that observers have the feelings of interference at displaying images other than medical images in the related art.

Accordingly, the present invention performs appropriate brightness control according to types of images to prevent observers from having the feelings of interference in a display apparatus capable of separately controlling the brightness of the light sources of a backlight according to the images.

According to a first aspect of the present invention, there is provided a display apparatus including:

a display panel;

a light emitting unit having a plurality of light sources and separately adjusting brightness of the respective light sources;

an acquiring unit configured to acquire a feature value of an input image for divided regions respectively corresponding to the plurality of light sources; and a control unit configured to make, in a case where the input image is a first image including a predetermined object image, brightness of light sources corresponding to divided regions determined to be dark regions based on the feature values of the respective divided regions lower than brightness of light sources corresponding to other divided regions, wherein in a case where the input image is a second image not including the predetermined object image, the control unit does not implement control operation of making the brightness of the light sources corresponding to the divided regions determined to be the dark regions lower than the brightness of the light sources corresponding to the other divided regions.

According to a second aspect of the present invention, there is provided a method for controlling a display apparatus having a display panel and a light emitting unit having a plurality of light sources and separately adjusting brightness of the respective light sources, the method comprising:

acquiring feature values of an input image for divided regions respectively corresponding to the plurality of light sources; and implementing a control operation of making, in a case where the input image is a first image including a predetermined object image, brightness of light sources corresponding to divided regions determined to be dark regions based on the feature values of the respective divided regions lower than brightness of light sources corresponding to other divided regions, wherein in a case where the input image is a second image not including the predetermined object image, the control operation of making the brightness of the light sources corresponding to the divided regions determined to be the dark regions lower than the brightness of the light sources corresponding to the other divided regions is not implemented.

According to a third aspect of the present invention, there is provided a display apparatus including:

a display panel;

a light emitting unit having a plurality of light sources and separately adjusting brightness of the respective light sources;

an acquiring unit configured to acquire feature values of an input image for divided regions respectively corresponding to the plurality of light sources; and a control unit configured to make, within a region displaying a first image including a predetermined object image in the input image, brightness of light sources corresponding to divided regions determined to be dark regions based on the feature values of the respective divided regions lower than brightness of light sources corresponding to other divided regions, wherein within a region displaying a second image not including the predetermined object image in the input image, the control unit does not implement control operation of making the brightness of the light sources corresponding to the divided regions determined to be the dark regions lower than the brightness of the light sources corresponding to the other divided regions.

According to a fourth aspect of the present invention, there is provided a method for controlling a display apparatus having a display panel and a light emitting unit having a plurality of light sources and separately adjusting brightness of the respective light sources, the method comprising:

acquiring feature values of an input image for divided regions respectively corresponding to the plurality of light sources; and implementing a control operation of making, within a region displaying a first image including a predetermined object image in the input image, brightness of light sources corresponding to divided regions determined to be dark regions based on the feature values of the respective divided regions lower than brightness of light sources corresponding to other divided regions, wherein within a region displaying a second image not including the predetermined object image of the input image, the control operation of making the brightness of the light sources corresponding to the divided regions determined to be the dark regions lower than the brightness of the light sources corresponding to the other divided regions is not implemented.

According to an embodiment of the present invention, it is possible to perform appropriate brightness control according to types of images to prevent observers from having the feelings of interference in a display apparatus capable of separately controlling the brightness of the light sources of a backlight according to the images.

Further features of the present invention will become apparent from the following description of exemplary embodiments with reference to the attached drawings.

BRIEF DESCRIPTION OF THE DRAWINGS

FIG. 4 shows an example of attribute determination results according to the first embodiment;

DESCRIPTION OF THE EMBODIMENTS

First Embodiment

Hereinafter, a description will be given of an embodiment of the present invention with reference to the drawings.

The display apparatus of a first embodiment divides an input image into a plurality of regions, detects the feature values of the respective divided regions of the image, and determines whether the input image is an image (first image) including a predetermined object image from the detected feature values. An object is, for example, an image of an object taken by radiation or ultrasonic waves, and an image including the object is, for example, a medical image for interpretation (interpretation image) such as an X-ray image. When determining that the input image is the medical image, the display apparatus determines whether the respective divided regions are object regions in which a predetermined object image (object to be interpreted) exists or background regions indicating the background of the predetermined object image. The display apparatus determines the brightness of a plurality of light sources constituting a backlight according to determination results. Thus, the display apparatus reduces the floating of dark parts in the background regions that are not to be observed in the medical image and reduces the feelings of interference when an observer (interpretation operator or the like) interprets the medical image displayed on the display apparatus.

Figure 1:
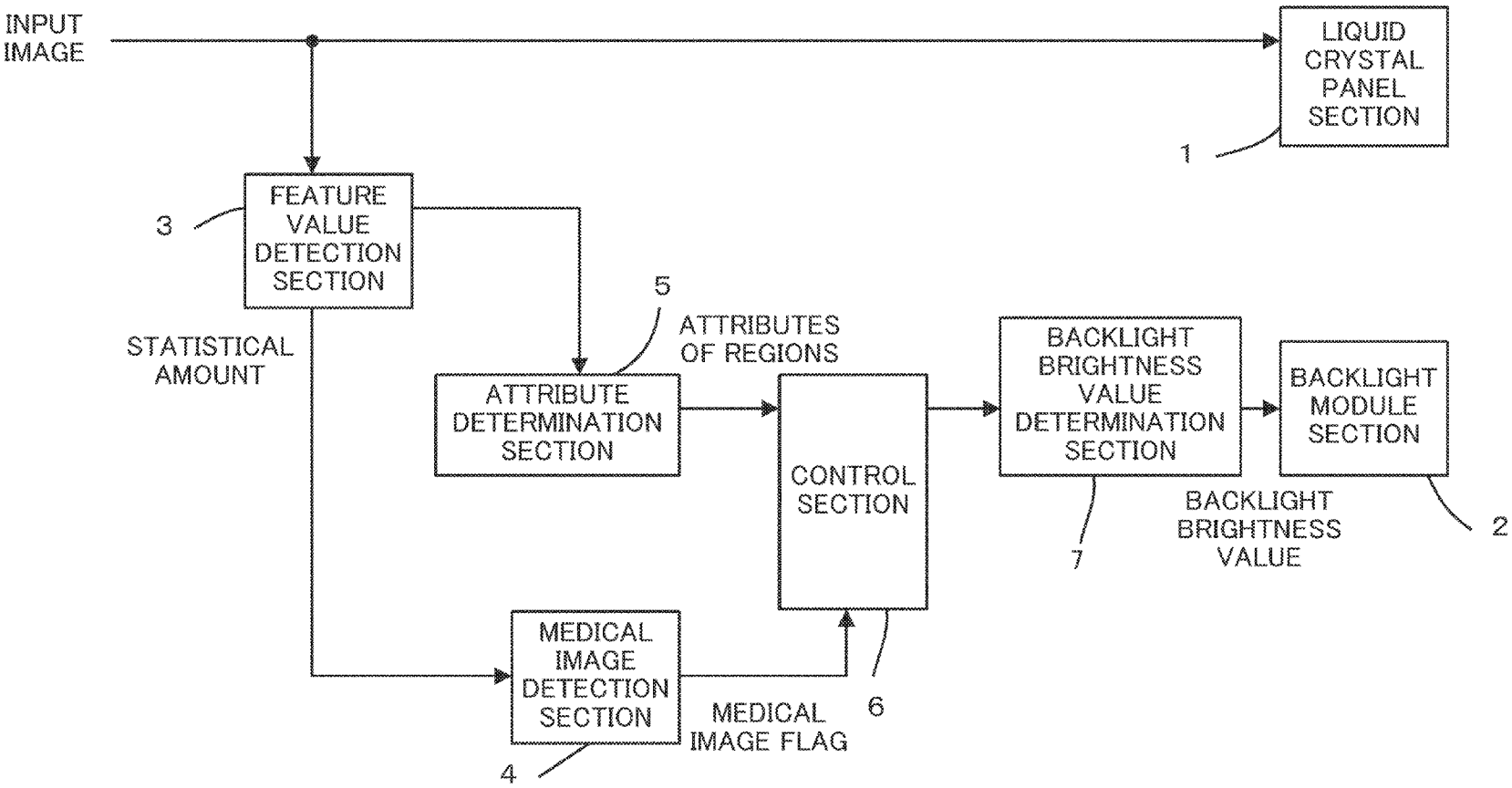
FIG. 1 shows a function block diagram of a display apparatus according to a first embodiment.

FIG. 1 shows a function block diagram of a display apparatus according to a first embodiment. As shown in FIG. 1, the display apparatus includes a liquid crystal panel section 1, a backlight module section 2, a feature value detection section 3, a medical image detection section 4, an attribute determination section 5, a control section 6, and a backlight brightness value determination section 7.

The liquid crystal panel section 1 includes a liquid crystal driver, a control substrate that controls the liquid crystal driver according to an input image signal, and a liquid crystal panel. Note that although the first embodiment describes an example using the liquid crystal panel as the display panel of the present invention, the display panel is not limited to the liquid crystal panel.

The backlight module section 2 includes light sources, a control circuit that controls the light sources, and an optical unit that diffuses light from the light sources. The backlight module section 2 has the plurality of light sources and is capable of separately adjusting the light emission brightness of the respective light sources. The backlight module section 2 is divided into a plurality of blocks corresponding to the respective light sources whose brightness is capable of being separately controlled, and the brightness of the respective blocks is determined by the backlight brightness value determination section 7. The control circuit of the backlight module section 2 controls the light emission of the respective light sources such that the respective light sources light up with the brightness determined by the backlight brightness value determination section 7. A block-based division number is m (width)×n (length) (where m and n are integers). In the first embodiment, it is assumed that the backlight module section 2 is divided into 10 (width)×7 (length) blocks. In addition, it is assumed that a region (divided region) of the liquid crystal panel section 1 corresponding to each of the blocks has 20 (width)×20 (length)=400 pixels. The number of the divided blocks of the backlight module section 2 may include but not limited to the above number.

Figures 2A, 2B, 2C, 2D:
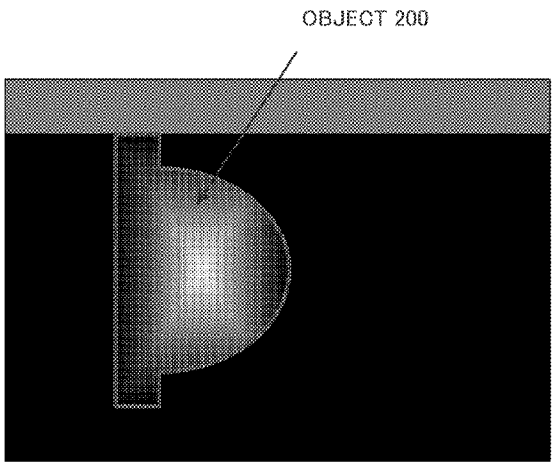
FIGS. 2A to 2D show an example of a medical image and examples of the feature values thereof.

The feature value detection section 3 divides the input image into regions (divided regions) corresponding to the respective blocks of the backlight module section 2 and detects the feature values of the respective divided regions. The feature value detection section 3 sends the detected feature values to the medical image detection section 4 and the attribute determination section 5 on the following stage. In the first embodiment, the feature value detection section 3 detects, as the feature values of the respective divided regions, maximum values, average values, and bright area values of the gradation values (RGB values) of pixels constituting the divided regions. Here, the bright area values are values obtained by counting the number of pixels having a gradation value of a preset threshold (sixth threshold) or more among the pixels constituting the divided regions without RGB discrimination. In the first embodiment, the input image has gradation values of 0 to 4095, and pixels having a gradation value of 60 or more are counted as bright pixels. That is, the sixth threshold is set at 60. A specific description will be given using FIGS. 2A to 2D. FIG. 2A shows an example of the input image, and FIGS. 2B, 2C, and 2D show the maximum values, the average values, and the bright area values of the gradation values of the respective divided regions of the input image of FIG. 2A detected by the feature value detection section 3. In FIGS. 2B, 2C, and 2D, the numbers 1 to 10 in a horizontal direction and the numbers 1 to 7 in a vertical direction show the coordinates of the divided regions in the horizontal and vertical directions. The input image of FIG. 2A has, in its upper region, a menu bar that serves as a graphical user interface (GUI) to constitute a viewer to display a medical image. The menu bar is constituted by a graphic uniform in the horizontal direction. In FIG. 2A, an object 200 is an image of an object taken by an X-ray or the like. As shown in FIG. 2B, the divided region at the coordinates (4,4) in which the object 200 exists has a maximum value of 2560, an average value of 2000, and a bright area value of 1200 as the gradation values. The divided region at the coordinates (4,1) in which the menu bar exists has a maximum value of 1536 and an average value of 1536 as the gradation values since the graphic is uniform, and has a bright area value of 1200. As the feature values of the respective divided regions, the feature value detection section 3 sends the acquired maximum values and the average values to the medical image detection section 4 and sends the acquired bright area values to the attribute determination section 5.

Based on the two feature values (the maximum values and the average values) detected by the feature value detection section 3, the medical image detection section 4 determines whether the input image is a first image including the predetermined object image or a second image not including the predetermined object image. The first image is a medical image taken by an X-ray. The second image is an image of an operating system (OS) output from, for example, a personal computer (PC). The medical image detection section 4 determines whether the respective divided regions are flat regions or dark flat regions. The flat regions are regions including only pixels in which a type of gradation values are a first threshold or less (for example, 2 or less) and that have intermediate gradation. The dark flat regions are regions including only pixels in which a type of gradation values is a fourth threshold or less (for example, 2 or less) and that have dark gradation. The pixels having the dark gradation are pixels in which a size of gradation values is a third threshold or less (for example, 64 or less). The medical image detection section 4 counts the determination results of the respective divided regions. The medical image detection section 4 compares the number of the divided regions determined to be the flat regions with a second threshold (CNth) and compares the number of the divided regions determined to be the dark flat regions with a fifth threshold (BCNth). The medical image detection section 4 determines that the input image is the second image (the image of the OS) when at least any of the condition under which the number of the divided regions determined to be the flat regions is the second threshold or more and the condition under which the number of the divided regions determined to be the dark flat regions is the fifth threshold or more is satisfied. Since the input image is not a multi-gradation image when any of these conditions is satisfied, the medical image detection section 4 determines that the input image is not the first image (the medical image). Hereinafter, the determination method will be described in detail.

In general, a medical image (the first image) including an image of an object taken by an X-ray or the like is constituted by multi-gradation (three or more gradation levels), and thus the number of types of gradation values is not reduced to 1 or 2. On the other hand, in an image of an OS shown in FIG. 5A, particularly a text display region and a region in which a graphic image of a GUI is displayed have only a few types of gradation values to constitute the image. Here, in FIG. 5A, an object 201 shows the text display region. Since the input image shown in FIG. 5A has only a few divided regions constituted by multi-gradation, a large number of flat regions are counted. When the ratio of flat regions to the whole frame image is large, it is assumed that an input image is not a medical image. However, like the image shown in FIG. 2A, some medical images have a large area in their dark background regions. In this case, the dark flat regions occupy a large area in the medical images. For this reason, the medical image detection section 4 determines the number of the flat regions separately from the number of the dark flat regions. The fifth threshold (BCNth) used to determine the number of dark flat regions is set to be larger than the second threshold (CNth) used to determine the number of flat regions having intermediate gradation. Thus, an input image that indicates a medical image and has a large dark background like the image of FIG. 2A is prevented from being falsely determined to be a "non-medical image." Hereinafter, the detailed configuration of the medical image detection section 4 will be described using a function block diagram.

Figure 3:
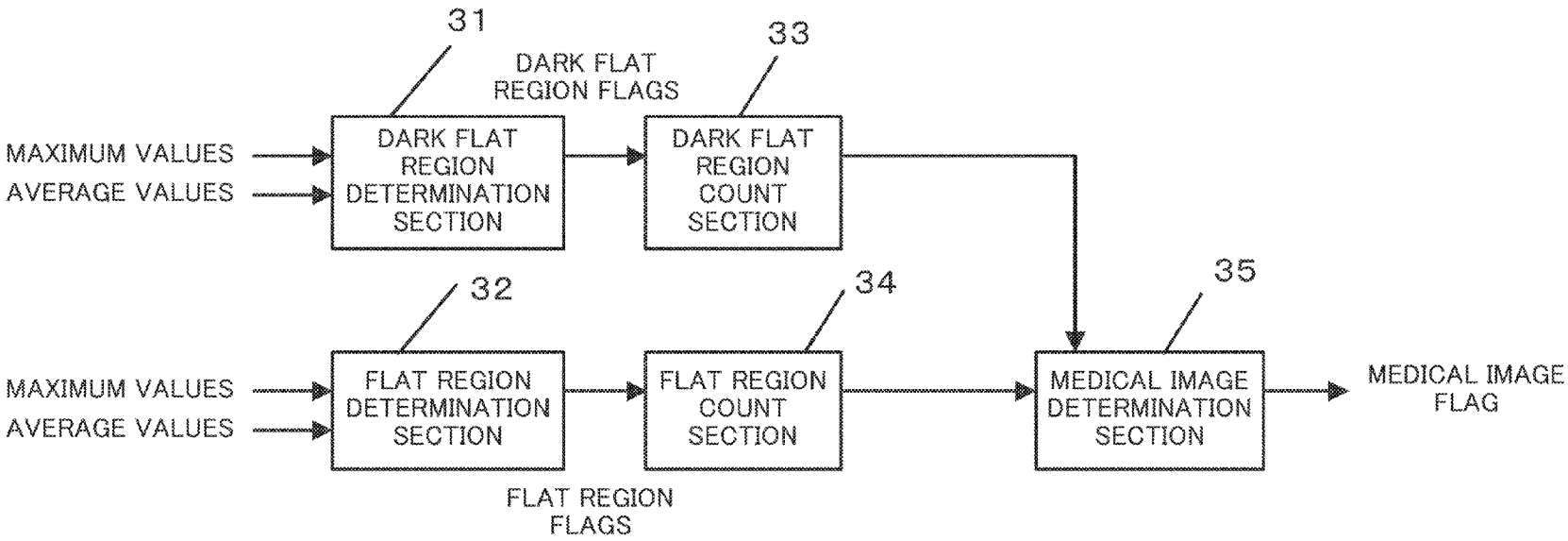
FIG. 3 shows a function block diagram of a medical image detection unit according to the first embodiment.

FIG. 3 shows a function block diagram of the medical image detection section 4. As shown in FIG. 3, the medical image detection section 4 has a dark flat region determination section 31, a flat region determination section 32, a dark flat region count section 33, a flat region count section 34, and a medical image determination section 35. The respective functions will be described below.

The dark flat region determination section 31 determines whether the respective divided regions are the dark flat regions from the maximum values and the average values of the gradation values of the respective divided regions sent from the feature value detection section 3. When the maximum values of the gradation values of the pixels in the divided regions indicate dark gradation and the differences between the maximum values and the average values are small, it is assumed that the image of the divided regions is not a multi-gradation image and the gradation values of the pixels in the divided regions are nearly uniform. Therefore, the dark flat region determination section 31 determines that the divided regions satisfying the following formulae 1 and 2 at the same time are the dark flat regions.

$$|\text{Maximum value}-\text{Average value}|\leq dL1 \quad \text{(Formula 1)}$$

$$Pa1\leq\text{Average value}\leq Pa2 \quad \text{(Formula 2)}$$

Here, dL1 (fourth threshold) and Pa1 and Pa2 (third thresholds) indicate preset values. In the first embodiment, it is assumed that dL1 is set at 2, Pa1 is set at 0, and Pa2 is set at 64. The dark gradation is stipulated by Pa1 and Pa2. In the first embodiment, it is stipulated that the dark gradation is up to 64. In addition, dL1 indicates the thresholds of the sizes of the differences between the maximum values and the average values used to determine the dark flat regions. When the divided regions are constituted by the pixels of one gradation value, the sizes of the differences between the maximum values and the average values are 0. However, when noise is caused in the image, the maximum values and the average values are not equal to each other. The fourth threshold dL1 is set at 2 such that the divided regions having nearly uniform gradation values may be determined to be the dark flat regions even if small noise is caused. For example, in the case of the input image of FIG. 2A, the divided region at the coordinates (2,2) has a maximum value of 0 and an average value of 0 and establishes the following relationships.

$$|\text{Maximum value}-\text{Average value}|=|0-0|\leq dL1$$

$$Pa1\leq 0\leq Pa2$$

Therefore, since both formulae 1 and 2 are satisfied, the dark flat region determination section 31 determines that the divided region is the dark flat region. On the other hand, the divided region at the coordinates (1,1) has a maximum value of 1536 and an average value of 1536 and establishes the following relationships.

$$|\text{Maximum value}-\text{Average value}|=|1536-1536|\leq dL1$$

$$Pa1\leq 1536\leq Pa2$$

Therefore, since formula 2 is not satisfied while formula 1 is satisfied, the dark flat region determination section 31 does not determine that the divided region is the dark flat region.

In the way described above, the dark flat region determination section 31 determines whether the respective divided regions are the dark flat regions. Then, the dark flat region determination section 31 sets the dark flat region flags of the divided regions determined to be the dark flat regions at 1 and sends the flags to the dark flat region count section 33 on the following stage. While, the dark flat region determination section 31 sets the dark flat region flags of the divided regions not determined to be the dark flat regions at 0 and sends the flags to the dark flat region count section 33 on the following stage.

The flat region determination section 32 determines whether the respective divided regions are the intermediate gradation flat regions from the maximum values and the average values of the gradation values of the respective divided regions sent from the feature value detection section 3. The flat region determination section 32 determines that the divided regions satisfying the following formulae 3 and 4 at the same time are the flat regions.

$$|\text{Maximum value}-\text{Average value}|dL2 \quad \text{(Formula 3)}$$

$$Pa3\leq \text{Average value}\leq Pa4 \quad \text{(Formula 4)}$$

(here, Pa1<Pa2<Pa3<Pa4)

dL2 (first threshold), Pa3, and Pa4 indicate preset thresholds. In the first embodiment, it is assumed that dL2 is set at 2, Pa3 is set at 65, and Pa4 is set at 1600. The intermediate gradation is stipulated by Pa3 and Pa4. In the first embodiment, it is stipulated that the gradation of 65 or more is the intermediate gradation. In addition, dL2 indicates the thresholds of the sizes of the differences between the maximum values and the average values used to determine the flat regions. In the first embodiment, it is assumed that the first threshold dL2 is set at 2 as in the case of the dark flat regions. Like the dark flat region determination section 31, the flat region determination section 32 determines whether the respective divided regions are the intermediate gradation flat regions. Then, the flat region determination section 32 sets the flat region flags of the divided regions determined to be the flat regions at 1 and sends the flags to the flat region count section 34 on the following stage. While, the flat region determination section 32 sets the flat region flags of the divided regions not determined to be the flat regions at 0 and sends the flags to the flat region count section 34 on the following stage. Note that although the thresholds Pa3 and Pa4 are set at 65 and 1600, respectively, in the embodiment, they may be set at any value. For example, the thresholds may be changed according to modality settings adjusted by an interpretation operator. In the above example, the intermediate gradation flat regions are determined by setting Pa4 at 1600. However, the flat regions of the intermediate-gradation to high gradation may be determined by setting Pa4, for example, at 4095.

The dark flat region count section 33 receives the dark flat region flags of the respective divided regions from the dark flat region determination section 31. When the dark flat region flags are set at 1, the dark flat region count section 33 increments a dark flat region count value by 1. When the dark flat region flags are set at 0, the dark flat region count section 33 does not change the dark flat region count value. In the case of the image of FIG. 2A, the dark flat region count value becomes 46 with the above parameters (dL1=2, Pa1=0, and Pa2=64). The dark flat region count section 33 determines whether all the divided regions of one frame are the dark flat regions to calculate the dark flat region count value. After that, the dark flat region count section 33 sends the dark flat region count value to the medical image determination section 35 and then clears the dark flat region count value to 0.

The flat region count section 34 receives the flat region flags of the respective divided regions from the flat region determination section 32. When the flat region flags are set at 1, the flat region count section 34 increments a flat region count value by 1. When the flat region flags are set at 0, the flat region count section 34 does not change the flat region count value. In the case of the image of FIG. 2A, the flat region count value becomes 10 with the above parameters (dL2=2, Pa3=65, and Pa4=1600). The flat region count section 34 thus determines whether all the divided regions of one frame are the flat regions to calculate the flat region count value. After that, the flat region count section 34 sends the flat region count value to the medical image determination section 35 and then clears the flat region count value to 0.

The medical image determination section 35 determines whether the input image is the medical image based on the dark flat region count value and the flat region count value. The medical image determination section 35 determines that the input image is not a multi-gradation image, i.e., it is not the medical image (but is the second image) when at least any of conditions shown in the following formulae 5 and 6 is satisfied. On the other hand, the medical image determination section 35 determines that the input image is the multi-gradation image and is the medical image (it is the first image) when both the conditions shown in the following formulae 5 and 6 are not satisfied.

$$\text{Dark flat region count value}\geq BCNth \quad \text{(Formula 5)}$$

$$\text{Flat region count value}\geq CNth \quad \text{(Formula 6)}$$

For example, when it is assumed in the first embodiment that BCNth is set at 60 and CNth is set at 30, the dark flat region count value becomes 46 and the flat region count value becomes 10 in the case of the image of FIG. 2A. Therefore, both the conditions shown in the above formulae 5 and 6 are not satisfied. Accordingly, the medical image determination section 35 determines that the image of FIG.

Figures 5A, 5B, 5C, 5D, 5E:
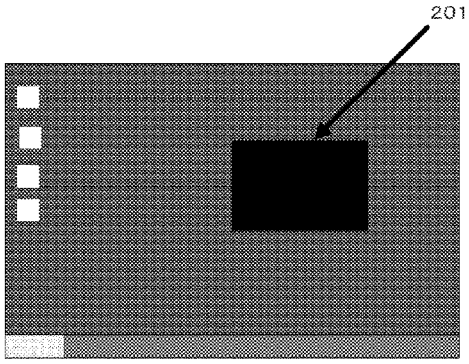
FIGS. 5A to 5E show an example of an image other than a medical image and examples of the feature values thereof.

2A is the medical image (the first image). On the other hand, when the image as shown in FIG. 5A in which the object 201 having dark gradation exists on an OS screen is input, the maximum values and the average values of the gradation values of the respective divided regions detected by the feature value detection section 3 are values shown in FIGS. 5B and 5C. From the feature values of FIGS. 5B and 5C, the dark flat region count value becomes 6 and the flat region count value becomes 48. Since BCNth is set at 60 and CNth is set at 30, the conditions of the dark flat region are not satisfied but the conditions of the flat region having the intermediate gradation are satisfied. Accordingly, the medical image determination section 35 determines that the image of FIG. 5A is not the medical image (it is the second image). In order to inform the unit on the following stage of such a determination result, the medical image determination section 35 outputs a medical image flag to the control section 6. When determining that the image of FIG. 2A is the "medical image (it is the first image)," the medical image determination section 35 sets the medical image flag at 1 and outputs the flag to the control section 6 on the following stage. When determining that the image of FIG. 5A is "not the medical image (it is the second image)," the medical image determination section 35 sets the medical image flag at 0 and outputs the flag to the control section 6.

The attribute determination section 5 performs attribute determination as to whether the respective divided regions are object regions in which an image of an object (object to be interpreted) exists or background regions including the background of the predetermined object image. Hereinafter, the attribute determination will be described in detail.

The attribute determination section 5 compares the bright area values of the respective divided regions acquired by the feature value detection section 3 with a preset threshold (seventh threshold) to determine the attributes of the respective divided regions. The attribute determination section 5 determines that the divided regions whose bright area value is larger than the seventh threshold are the object regions and determines that the divided regions whose bright area value is the seventh threshold or less are the background regions. The attribute determination section 5 sends results thus determined to the control section 6 on the following stage. Hereinafter, a specific operation example of the attribute determination section 5 will be described using the images of FIGS. 2A and 5A.

Since the medical image flag of the image of FIG. 2A is set at 1, the attribute determination section 5 determines the attributes of the respective divided regions. The attribute determination section 5 receives the bright area values of the respective divided regions shown in FIG. 2D from the feature value detection section 3. In the first embodiment, it is assumed that the seventh threshold is set at 90. In this case, the attribute determination results of the respective divided regions are shown in FIG. 4. Among the respective divided regions of FIG. 4, the divided regions determined to be the object regions are indicated by the value 1 and the divided regions determined to be the background regions are indicated by the value 0. In the case of the image of FIG. 5A, the attribute determination results are shown in FIG. 5E. The bright area values of the image of FIG. 5A are shown in FIG. 5D, and the bright area values are the seventh threshold or less only in the regions of the object 201. Accordingly, as shown in FIG. 5E, only the divided regions corresponding to the object 201 are determined to be the background regions, and the values of the attribute determination results become 0. The remaining divided regions are determined to be the object regions since the bright area values are larger than 90 (the seventh threshold), and the values of the attribute determination results become 1. Note that the first embodiment shows the example in which the divided regions having small bright area values are determined to be the background regions using the bright area values of the divided regions. As another determination method, it may be possible to determine that the divided regions are the background regions when the maximum values of the gradation values of the divided regions indicate small gradation determined to be dark parts. For example, it may be possible that the divided regions having a maximum gradation larger than an eighth threshold are the object regions and determine that the divided regions having a maximum gradation value of the eighth threshold or less are the background regions. The attribute determination section 5 outputs the attributes of the respective divided regions thus determined to the control section 6 on the following stage.

When it is determined by the medical image detection section 4 that the input image is the medical image (the first image), i.e., when the medical image flag sent from the medical image detection section 4 is set at 1, the control section 6 outputs the results of the attribute determination section 5 to the backlight brightness value determination section 7 on the following stage as they are. In addition, when the medical image flag is set at 0, i.e., when it is determined that the input image is not the medical image (it is the second image), the control section 6 performs processing to invalidate local dimming. In order to invalidate the local dimming, the control section 6 handles the attributes of all the divided regions as the object regions regardless of the determination results of the attribute determination section 5. That is, the control section 6 sets the attribute determination results of all the divided regions at 1 and outputs the same to the backlight brightness value determination section 7 on the following stage. The local dimming is invalidated by the processing since the backlight brightness value determination section 7 determines to apply the local dimming according to whether the attribute determination results indicate the background regions or the object regions as will be described later. Specifically, the backlight brightness value determination section 7 applies the local dimming to the light sources corresponding to the divided regions indicating the background regions and does not apply the local dimming to the light sources corresponding to the divided regions indicating the object regions. The second image other than the medical image, for example, an image of an OS or an image other than the medical image is an image that requires gradation expression in dark parts or an image that requires reduction in halo. When the input image is the second image, the local dimming is not applied (the brightness of the light sources is made uniform) regardless of the attribute determination results. Therefore, the brightness of the light sources of the backlight does not reduce in the dark parts that require gradation expression or the text region of a dark background. Accordingly, the gradation expression is allowed in the dark parts, and interference due to halo is restrained. Note that the above embodiment describes the example in which the attribute determination results of the respective divided regions are corrected to control the application of the local dimming when the input image is not the medical image. As another method, it may be possible for the control section 6 to directly instruct the backlight brightness value determination section 7 on the following stage to light the light sources corresponding to all the divided regions with constant brightness (brightness of a case in which the local dimming is not applied) when it is determined that the input image is not the medical image.

The backlight brightness value determination section 7 receives the attribute determination results of the respective divided regions from the control section 6 and determines the brightness of the light sources corresponding to the respective divided regions. The backlight brightness value determination section 7 sets the brightness of the light sources corresponding to the divided regions determined to be the object regions at the same brightness as that of the case in which the local dimming is not applied. In addition, the backlight brightness value determination section 7 sets the brightness of the light sources corresponding to the divided regions determined to be the background regions at brightness lower than that of the case in which the local dimming is not applied. For example, when reducing brightness in black of the background regions to 1/10, the backlight brightness value determination section 7 reduces the brightness of the light sources corresponding to the background regions to 1/10 the brightness. Accordingly, the backlight darkens in the dark background of the medical image of FIG. 2A. However, the backlight has normal brightness in the region of the object 201 of FIG. 5A, and thus halo is restrained. The backlight brightness value determination section 7 sends the brightness of the respective light sources thus determined to the backlight module section 2. Note that a reduction degree to which the brightness of the light sources corresponding to the background regions is reduced in the case of the medical image may be determined according to the preference of an interpretation operator or the degree of the feelings of interference due to halo and is not limited to 1/10.

With the above configuration, the display apparatus of the first embodiment determines whether the input image is the medical image and determines the brightness of the respective light sources of the backlight based on the determination results and the feature values of the image. Thus, in a case in which the input image is the medical image, the light sources of the backlight of the dark background regions are darkened by the local dimming to reduce black floating and the feelings of interference due to the black floating when an interpretation operator or the like performs interpretation. In a case in which the input image is not the medical image, the brightness of the light sources of the backlight does not reduce even in the dark regions. Therefore, halo is restrained, and the gradation of the dark regions may be expressed.

Figure 6A:
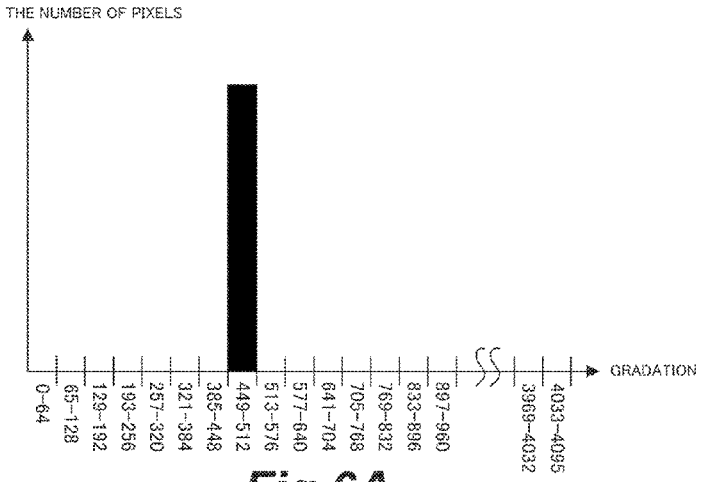
FIGS. 6A to 6C show an example of histograms according to the first embodiment.
Figure 6B:
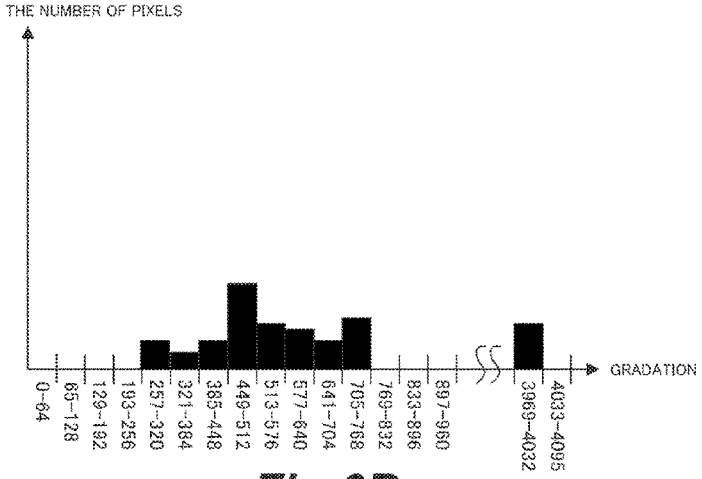
Figure 6C:
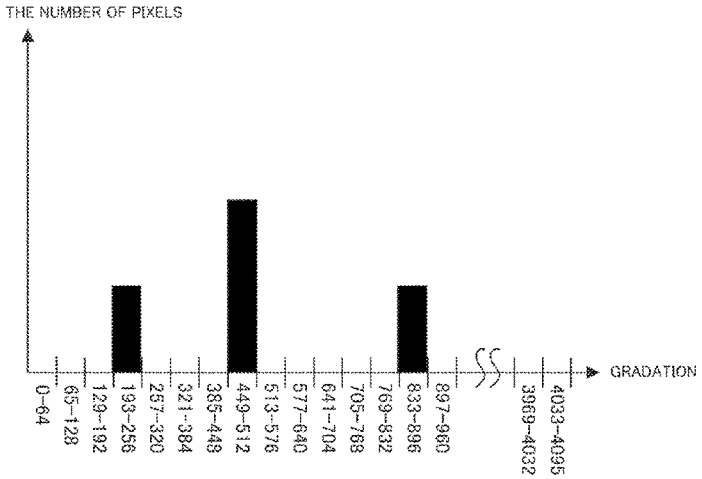

The above first embodiment describes the example in which determination is made as to whether the respective divided regions are the dark flat regions or the intermediate gradation flat regions based on the maximum values and the average values of the gradation values of the respective divided regions to determine whether the input image is the medical image. As another method, it may be possible for the feature value detection section 3 to acquire the histograms of the gradation values of the respective divided regions and determine whether the respective divided regions are the dark flat regions or the intermediate gradation flat regions from the distribution of the frequencies of the histograms. According to the method, the determination may be made with higher precision. Here, the distribution of the frequencies of the histograms will be described using FIGS. 6A to 6C. In FIGS. 6A and 6B, a horizontal axis indicates gradation values, and a vertical axis indicates frequencies (the number of pixels). For example, when a pixel has a gradation value of 450, it is counted as having a frequency in the gradation range of 449 to 512. In the histograms of the divided regions thus acquired, the medical image detection section 4 determines that the divided regions are the flat regions when the frequencies center on one gradation range as shown in FIG. 6A. Moreover, when the frequencies center on one gradation range of, for example, a range of 0 to 64, the medical image detection section 4 determines that the divided regions are the dark flat regions. On the other hand, when the frequencies are dispersed in a plurality of gradation ranges as shown in FIG. 6B, the medical image detection section 4 determines that the divided regions are not the flat regions. As described above, it may be possible to acquire the histograms of the respective divided regions and make determination as to whether the divided regions are the flat regions from the histograms to determine whether the input image is the medical image. In addition, it may be possible to determine whether the input image is the medical image from the histogram of the whole input image. For example, when the histogram of the whole input image is acquired and the frequencies center on three or less specific gradation ranges as shown in FIG. 6C, the medical image detection section 4 may determine that the input image is not the medical image.

The above first embodiment describes the example in which determination is made as to whether the whole input image is the first image (the medical image) including the predetermined object image or is the second image (the image of the OS or the image other than the medical image) not including the image of the object. However, there is a likelihood that the display regions of the first and second images are mixed together in the input image. For example, there is a likelihood that the display region of the medical image is arranged on the left half side of a screen and the text display region is arranged on the right half side of the screen. In such a case, it may be possible to apply the local dimming, which reduces the brightness of the backlight in the dark background regions, to the display region of the medical image, and may not reduce the brightness of the backlight even in the dark background regions in the text display region.

Figure 7:
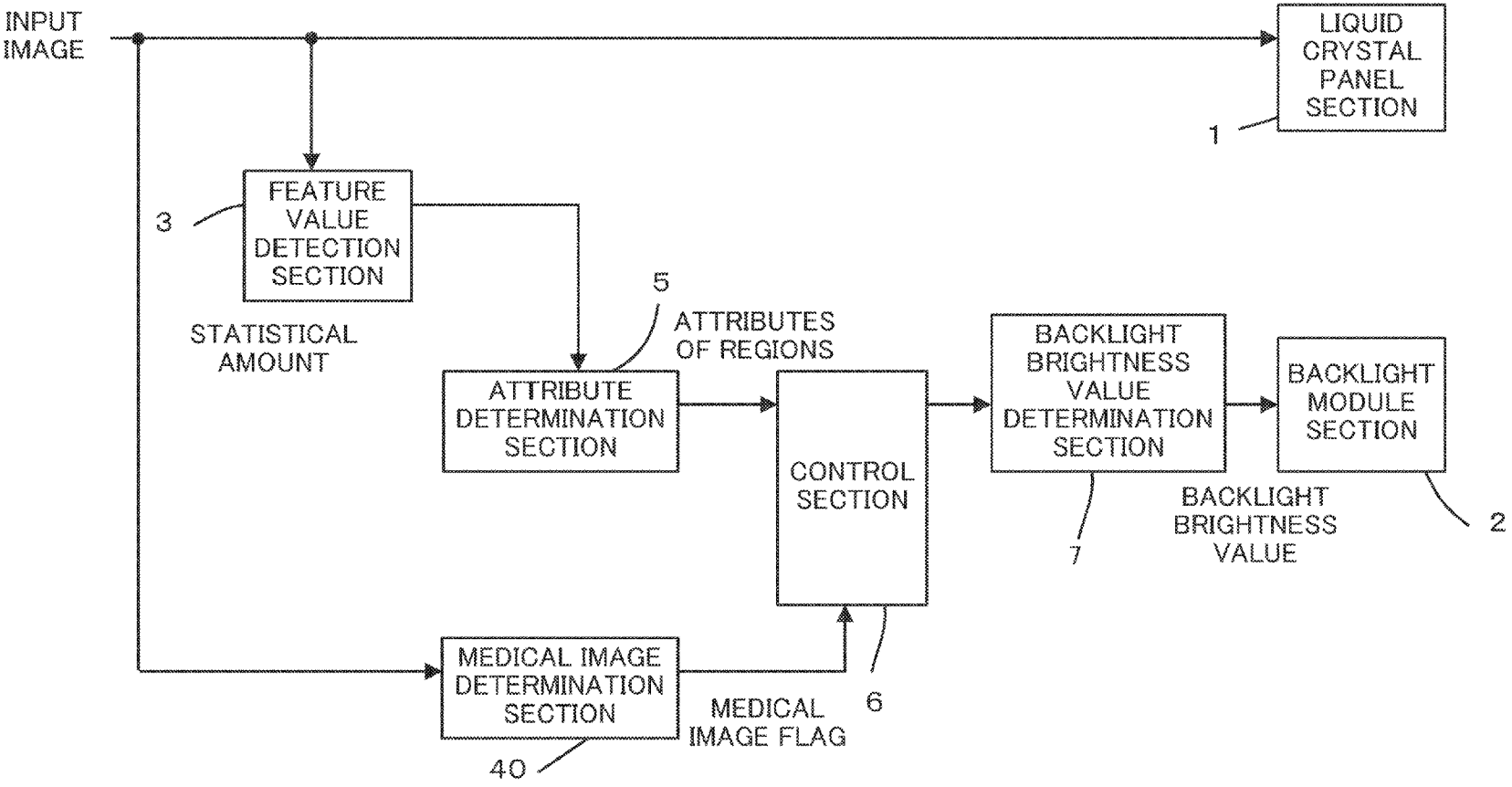
FIG. 7 is a function block diagram of the display according to a modified example of the first embodiment.

The above first embodiment describes the example in which the medical image detection section 4 determines whether the input image is the medical image (the first image) or the image (the second image) other than the medical image based on the feature values of the input image. However, any method for determining the input image may be employed. For example, it may be possible to determine whether the input image is the medical image based on metadata included in image data. FIG. 7 shows a configuration in a case in which determination is made as to whether the input image is the medical image based on information added to image data as metadata. The medical image determination section 40 reads the metadata of the input image and acquires information indicating whether the image is the medical image from the metadata. When the information indicating that the image is the medical image is detected from the metadata, the medical image determination section 40 sets the medical image flag at 1. When the information indicating that the image is the medical image is not detected from the metadata, the medical image determination section 40 sets the medical image flag at 0. The metadata is information indicating a type of an image such as a radiogram interpretation image and a medical image. According to the configuration of FIG. 7, it is possible to perform the application of the local dimming based on the information added to the image data.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-240503, filed on Nov. 27, 2014, and Japanese Patent Application No. 2015-217743, filed on Nov. 5, 2015, which are hereby incorporated by reference herein in their entirety.

What is claimed is:

1. A display apparatus comprising:

a display panel;

a light emitting unit having a plurality of light sources, brightness of the respective light sources being separately adjustable;

an acquiring unit configured to acquire feature values of an input image for divided regions respectively corresponding to the plurality of light sources; and a control unit configured to implement, in a case where the input image is a first image including a predetermined object image, a control operation of controlling brightness of light sources corresponding to divided regions determined to be dark regions based on the feature values of the respective divided regions lower than brightness of light sources corresponding to other divided regions, wherein the control unit determines, based on gradation values of pixels constituting the divided regions, whether the respective divided regions are flat regions in which the number of levels of gradation values of pixels constituting the divided regions is a first threshold or less, and determines that the input image is a second image not including the predetermined object image in a case where the number of divided regions determined to be the flat regions is a predetermined number or more, and in a case where the input image is the second image, the control unit does not implement the control operation of controlling the brightness of the light sources corresponding to the divided regions determined to be the dark regions lower than the brightness of the light sources corresponding to the other divided regions.

2. The display apparatus according to claim 1, wherein in a case where the input image is the second image not including the predetermined object image, the control unit implements a control operation of controlling the brightness of the light sources corresponding to the divided regions determined to be the dark regions same as the brightness of the light sources corresponding to the other divided regions.

3. The display apparatus according to claim 1, wherein the control unit determines whether the input image is the first image or the second image based on the feature values of the plurality of divided regions.

4. The display apparatus according to claim 1, wherein the acquiring unit acquires maximum values and average values of the gradation values of the pixels constituting the divided regions as the feature values of the respective divided regions, and the control unit determines that a divided region, in which magnitude of difference between the maximum value and the average value of the gradation values is the first threshold or less, is the flat region.

5. The display apparatus according to claim 1, wherein the acquiring unit acquires histograms of the gradation values of the pixels constituting the divided regions as the feature values of the respective divided regions, and the control unit determines that a divided region, in which frequency centers on a specific gradation value in the histograms of the gradation values, is the flat region.

6. The display apparatus according to claim 1, wherein the control unit determines whether the input image is the first image or not based on information indicating an image type added to the input image as metadata.

7. The display apparatus according to claim 6, wherein the control unit determines that the input image is the first image in a case where information indicating that the image is a medical image is added to the input image as the metadata.

8. The display apparatus according to claim 1, wherein the first image is a medical image for interpretation including an image of an object, which is taken by radiation or ultrasonic waves, as the predetermined object image.

9. The display apparatus according to claim 1, wherein the second image is an image constituted by a graphic and a text.

10. A display apparatus comprising:

a display panel;

a light emitting unit having a plurality of light sources and separately adjusting brightness of the respective light sources;

an acquiring unit configured to acquire a feature value of an input image for divided regions respectively corresponding to the plurality of light sources; and a control unit configured to implement, in a case where the input image is a first image including a predetermined object image, a control operation of controlling brightness of light sources corresponding to divided regions determined to be dark regions based on the feature values of the respective divided regions lower than brightness of light sources corresponding to other divided regions, wherein the control unit determines whether the respective divided regions are dark flat regions in which each gradation value of pixels constituting the divided regions is a third threshold or less and the number of levels of the gradation values of the pixels constituting the divided regions is a fourth threshold or less, and determines that the input image is a second image not including the predetermined object image in a case where the number of divided regions determined to be the dark flat regions is a fifth threshold or more, and in a case where the input image is the second image, the control unit does not implement the control operation of controlling the brightness of the light sources corresponding to the divided regions determined to be the dark regions lower than the brightness of the light sources corresponding to the other divided regions.

11. The display apparatus according to claim 10, wherein the acquiring unit acquires maximum values and average values of the gradation values of the pixels constituting the divided regions as the feature values of the respective divided regions, and the control unit determines that a divided region, in which magnitude of difference between the maximum value and the average value of the gradation values is the fourth threshold or less and magnitude of the average value is the third threshold or less, is the dark flat region.

12. The display apparatus according to claim 10, wherein the acquiring unit acquires histograms of the gradation values of the pixels constituting the divided regions as the feature values of the respective divided regions, and the control unit determines that a divided region, in which frequency centers on a specific gradation value of the third threshold or less in the histogram of the gradation values, is the dark flat region.

13. A display apparatus comprising:

a display panel;

a light emitting unit having a plurality of light sources and separately adjusting brightness of the respective light sources;

an acquiring unit configured to acquire a feature value of an input image for divided regions respectively corresponding to the plurality of light sources; and a control unit configured to implement, in a case where the input image is a first image including a predetermined object image, a control operation of controlling brightness of light sources corresponding to divided regions determined to be dark regions based on the feature values of the respective divided regions lower than brightness of light sources corresponding to other divided regions, wherein the control unit determines whether the respective divided regions are flat regions in which the number of levels of gradation values of pixels constituting the divided regions is a first threshold or less while determining whether the respective divided regions are dark flat regions in which each gradation value of the pixels constituting the divided regions is a third threshold or less and the number of levels of the gradation values of the pixels constituting the divided regions is a fourth threshold or less, and determines that the input image is a second image not including the predetermined object image in a case where at least any of a condition under which the number of divided regions determined to be the flat regions is a second threshold or more and a condition under which the number of divided regions determined to be the dark flat regions is a fifth threshold or more is satisfied, and in a case where the input image is the second image, the control unit does not implement the control operation of controlling the brightness of the light sources corresponding to the divided regions determined to be the dark regions lower than the brightness of the light sources corresponding to the other divided regions.

14. The display apparatus according to claim 13, wherein the fifth threshold is larger than the second threshold.

15. A display apparatus comprising:

a display panel;

a light emitting unit having a plurality of light sources and separately adjusting brightness of the respective light sources;

an acquiring unit configured to acquire a feature value of an input image for divided regions respectively corresponding to the plurality of light sources; and a control unit configured to control, in a case where the input image is a first image including a predetermined object image, brightness of light sources corresponding to divided regions determined to be dark regions based on the feature values of the respective divided regions lower than brightness of light sources corresponding to other divided regions, wherein, in a case where the input image is the first image, the control unit assigns attributes of background regions indicating a background of the predetermined object image to the divided regions determined to be the dark regions, assigns attributes of object regions in which the predetermined object image exists to the other divided regions, and reduces brightness of light sources corresponding to the divided regions, to which the attributes of the background regions are assigned, based on the feature values of the divided regions while setting a specific brightness to light sources corresponding to the divided regions, to which the attributes of the object regions are assigned.

16. The display apparatus according to claim 15, wherein the acquiring unit acquires, as the feature values of the respective divided regions, bright area values indicating the number of pixels having a gradation value of a sixth threshold or more among pixels constituting the divided regions, and the control unit assigns the attribute of the object region to a divided region having a bright area value larger than a seventh threshold and assigns the attribute of the background region to a divided region having a bright area value of the seventh threshold or less.

17. The display apparatus according to claim 15, wherein the acquiring unit acquires, as the feature values of the respective divided regions, maximum values of gradation values of pixels constituting the divided regions, and the control unit assigns the attribute of the object region to a divided region having a maximum gradation value larger than an eighth threshold and assigns the attribute of the background region to a divided region having a maximum gradation value of the eighth threshold or less.

18. A method for controlling a display apparatus having a display panel and a light emitting unit having a plurality of light sources, brightness of the respective light sources being separately adjustable, the method comprising:

acquiring, by an acquiring unit, feature values of an input image for divided regions respectively corresponding to the plurality of light sources; and implementing, by a control unit, in a case where the input image is a first image including a predetermined object image, a control operation of controlling brightness of light sources corresponding to divided regions determined to be dark regions based on the feature values of the respective divided regions lower than brightness of light sources corresponding to other divided regions, wherein in the control operation, whether the respective divided regions are flat regions in which the number of levels of gradation values of pixels constituting the divided regions is a first threshold or less is determined based on gradation values of pixels constituting the divided regions, and it is determined that the input image is a second image not including the predetermined object image in a case where the number of divided regions determined to be the flat regions is a predetermined number or more, and in a case where the input image is the second image, the control operation of controlling the brightness of the light sources corresponding to the divided regions determined to be the dark regions lower than the brightness of the light sources corresponding to the other divided regions is not implemented.

19. A method for controlling a display apparatus having a display panel and a light emitting unit having a plurality of light sources and separately adjusting brightness of the respective light sources, the method comprising:

acquiring, by an acquiring unit, feature values of an input image for divided regions respectively corresponding to the plurality of light sources; and implementing, by a control unit, in a case where the input image is a first image including a predetermined object image, a control operation of controlling brightness of light sources corresponding to divided regions determined to be dark regions based on the feature values of the respective divided regions lower than brightness of light sources corresponding to other divided regions, wherein in the control operation, whether the respective divided regions are dark flat regions in which each gradation value of pixels constituting the divided regions is a third threshold or less and the number of levels of the gradation values of the pixels constituting the divided regions is a fourth threshold or less is determined, and it is determined that the input image is a second image not including the predetermined object image in a case where the number of divided regions determined to be the dark flat regions is a fifth threshold or more, and in a case where the input image is the second image, the control operation of controlling the brightness of the light sources corresponding to the divided regions determined to be the dark regions lower than the brightness of the light sources corresponding to the other divided regions is not implemented.

20. A method for controlling a display apparatus having a display panel and a light emitting unit having a plurality of light sources and separately adjusting brightness of the respective light sources, the method comprising:

acquiring, by an acquiring unit, feature values of an input image for divided regions respectively corresponding to the plurality of light sources; and implementing, by a control unit, in a case where the input image is a first image including a predetermined object image, a control operation of controlling brightness of light sources corresponding to divided regions determined to be dark regions based on the feature values of the respective divided regions lower than brightness of light sources corresponding to other divided regions, wherein in the control operation, whether the respective divided regions are flat regions in which the number of levels of gradation values of pixels constituting the divided regions is a first threshold or less is determined while whether the respective divided regions are dark flat regions in which each gradation value of the pixels constituting the divided regions is a third threshold or less and the number of levels of the gradation values of the pixels constituting the divided regions is a fourth threshold or less is determined, and it is determined that the input image is a second image not including the predetermined object image in a case where at least any of a condition under which the number of divided regions determined to be the flat regions is a second threshold or more and a condition under which the number of divided regions determined to be the dark flat regions is a fifth threshold or more is satisfied, and in a case where the input image is the second image, the control unit does not implement the control operation of controlling the brightness of the light sources corresponding to the divided regions determined to be the dark regions lower than the brightness of the light sources corresponding to the other divided regions is not implemented.

21. A method for controlling a display apparatus having a display panel and a light emitting unit having a plurality of light sources and separately adjusting brightness of the respective light sources, the method comprising:

acquiring, by an acquiring unit, feature values of an input image for divided regions respectively corresponding to the plurality of light sources; and implementing, by a control unit, in a case where the input image is a first image including a predetermined object image, a control operation of controlling brightness of light sources corresponding to divided regions determined to be dark regions based on the feature values of the respective divided regions lower than brightness of light sources corresponding to other divided regions, wherein in the control operation, in a case where the input image is the first image, attributes of background regions indicating a background of the predetermined object image are assigned to the divided regions determined to be the dark regions, attributes of object regions in which the predetermined object image exists are assigned to the other divided regions, and brightness of light sources corresponding to the divided regions, to which the attributes of the background regions are assigned, is reduced based on the feature values of the divided regions while a specific brightness is set to light sources corresponding to the divided regions, to which the attributes of the object regions are assigned.

* * * * *